United States Patent [19]

Wetter

[11] Patent Number: 4,989,391

[45] Date of Patent: Feb. 5, 1991

[54] AUTOMATIC BAGGING, HEAT SEALING AND DISCHARGE MACHINE

[75] Inventor: Bruno Wetter, St-Eustache, Canada

[73] Assignee: Glopak Inc., Montreal, Canada

[21] Appl. No.: 480,712

[22] Filed: Feb. 15, 1990

[51] Int. Cl.[5] ..... B65B 43/14; B65B 43/36; B65B 51/14; B65B 51/32

[52] U.S. Cl. ..... 53/131; 53/572; 53/379; 53/202

[58] Field of Search ..... 53/572, 379, 202, 385, 53/386, 468, 469, 459, 479, 483, 370, 131, 138 A

[56] References Cited

U.S. PATENT DOCUMENTS

| | | | |
|---|---|---|---|
| 3,479,795 | 11/1969 | Martin | 53/202 X |
| 3,789,570 | 2/1974 | Mullins, Jr. | 53/572 X |
| 3,822,527 | 7/1974 | Germunson et al. | 53/572 |
| 3,948,019 | 4/1976 | Döring et al. | 53/385 X |
| 4,107,903 | 8/1978 | Wickersheim | 53/202 X |
| 4,124,966 | 11/1978 | Wilson | 53/385 X |
| 4,177,621 | 12/1979 | Powell, Jr. | 53/572 X |
| 4,253,292 | 3/1981 | Lipes | 53/572 X |
| 4,291,517 | 9/1981 | Lipes | 53/572 X |
| 4,368,608 | 1/1983 | Ray | 53/572 X |
| 4,706,298 | 11/1987 | Lipes et al. | 53/479 X |

*Primary Examiner*—Horace M. Culver
*Attorney, Agent, or Firm*—Burns, Doane, Swecker & Mathis

[57] ABSTRACT

An automatic bagging machine comprising a collector for receiving a predetermined number of articles to be placed in a single bag therein. A trap door is disposed under the collector. A first bag on a wicker is opened, filled through the trap door, and dropped onto a first bag support platform. A clamp retains a top end portion of the bag on a clamping surface after it has been filled and the support platform is displaced to a sealing station where a section of the top end portion of the bag, spaced from the mouth opening, is guided in a bag gathering mechanism to gather that section. The gathered section is then heat sealed. During the sealing operation, a second bag support platform is positioned under the trap door. After another filled bag is dropped onto the second support platform, both platforms are displaced with the sealed bag being retained by the sealing mechanism and supported for a predetermined number of time to cause the heat seal to properly fuse and thereafter release the bag onto a discharge conveyor.

19 Claims, 4 Drawing Sheets

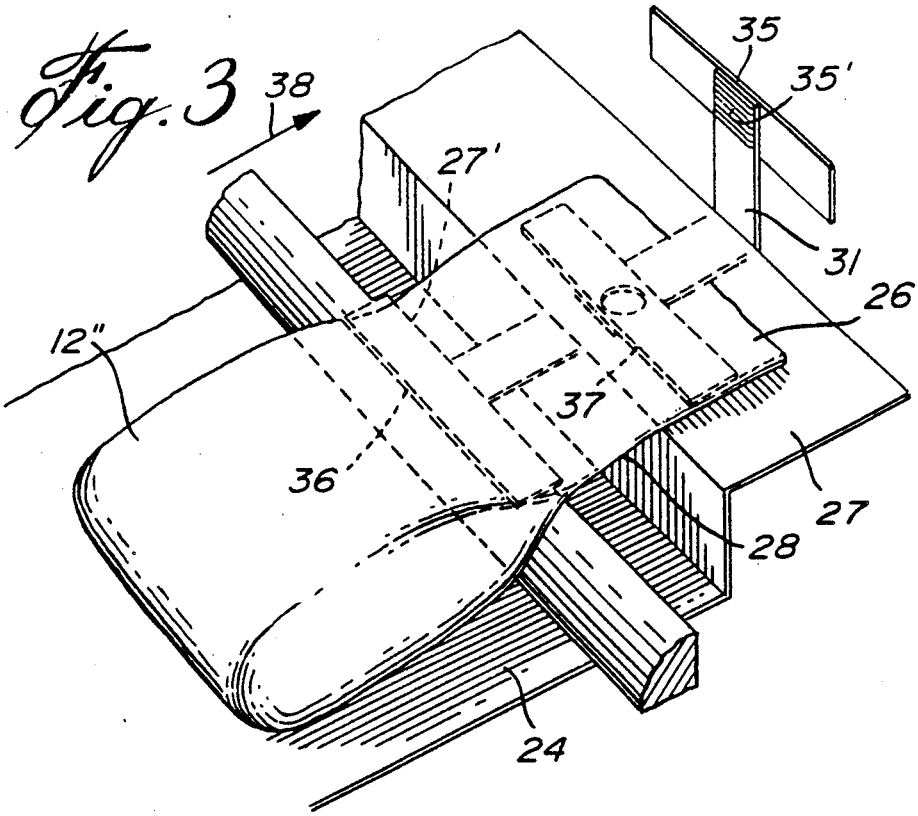
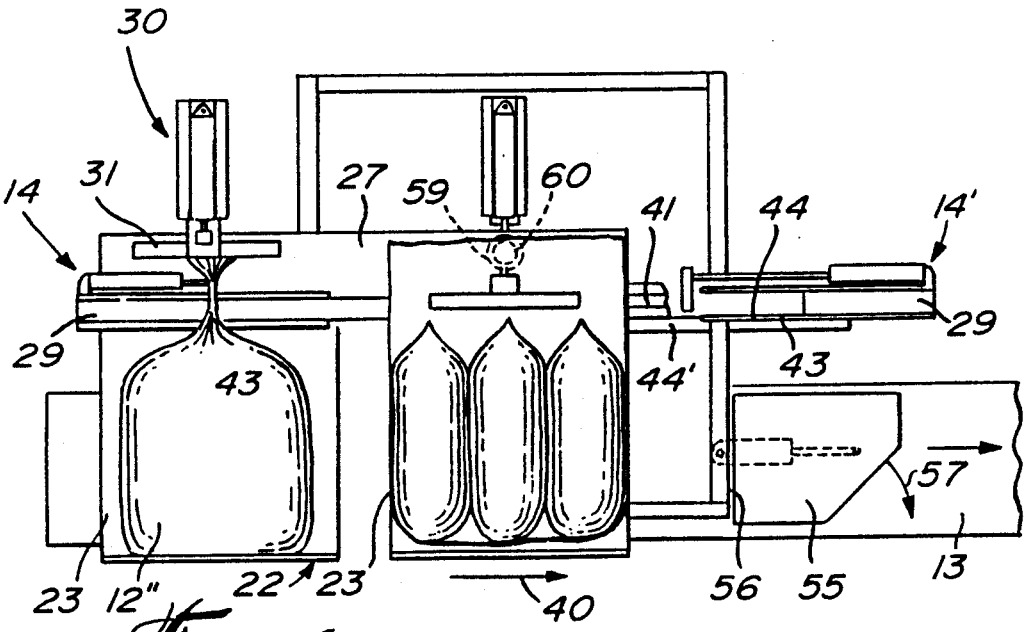
Fig. 4

AUTOMATIC BAGGING, HEAT SEALING AND DISCHARGE MACHINE

BACKGROUND OF INVENTION

1. Field of the Invention

The present invention relates to improvements in an automatic bag loading and heat sealing machine, and wherein two or more articles may be placed in a bag and the bag heat sealed and cooled prior to releasing the bag on a transport conveyor.

2. Description of Prior Art

More specifically, this invention relates to improvements in automatic loading and bagging machines of the type described in Canadian Patent No. 925,480 issued on May 1, 1973. In that particular patented machine, milk pouches were fed to a collator and were placed in various compartments by gravity-operated chutes. The articles were then dispensed in a bag which, upon placement of articles therein, ripped itself from wicker pins and fell onto a conveyor to be conveyed for further processing. A major disadvantage of that apparatus is that it is slow and problematic. For example, when an open bag is conveyed with products therein, it often occurs that the product will fall out of the bag and sometimes result in machine shut-down in order to clean out the spilled convents. This is time-consuming, requires constant supervision, and is costly.

Another problem with bag loading machines employing heat sealers is that the bag is usually released on the discharge conveyor immediately after the heat seal is made. Because the plastic in the sealed region is still in a molten state, it often occurs that the seal becomes undone and this causes the contents of the bag to fall out. This is particularly true when the bag contains very small articles such as sand or grain as only a small opening in the fused area will cause the product to leak out of the bag.

SUMMARY OF INVENTION

The present invention is an improvement of this type of machine, and wherein articles are placed in a compartment by chutes which are pneumatically operated by a control circuit to ascertain that the loading compartment is filled with the desired articles prior to releasing same in a bag and wherein the bag is displaced to a heat sealing device which gathers the bag and heat seals and cools the seal prior to freely releasing the bag.

Another feature of the present invention is to provide an automatic bagging machine which is fully automatic and requires little supervision, and which is substantially trouble-free.

Another feature of the present invention is to provide an automatic bagging machine wherein the bag, filled with the desired articles, is supported at a loading station within the machine where the top portion of the bag is pulled taut prior to gathering and sealing.

Another feature of the present invention is to provide an automatic bagging machine wherein information is further printed on the free end portion of the bag prior to releasing same onto a discharge conveyor.

Another feature of the present invention is to provide an automatic bagging machine which operates much faster than the known bagging machines of the prior art, and which has a longer life expectancy due to its pneumatic controlled operation.

According to the above features, from a broad aspect, the present invention provides an automatic bagging machine for positioning articles in a bag and sealing the bag prior to releasing same on conveying means to displace it from the machine. The machine comprises a collector for receiving a predetermined number of articles to be placed in a single bag. A trap door is provided under the collector. Support means is provided for holding a plurality of stacked collapsed bags having an open top end. Means is provided for holding a first of the stacked bags adjacent the trap door. Means is also provided for opening the first bag to position its open end under the trap door. Control means releases the predetermined number of articles in the open end of the first bag. Displaceable support means is provided and has a first bag support platform which is positioned spaced under the collector for supporting the bag from a bottom end thereof when the articles are disposed within said bag. Clamping means is also provided to retain a top open end portion of the bag on a clamping surface. Means is still further provided to displace the displaceable support means to position the bag with the articles therein to a sealing station where a section of the top end portion of the bag, spaced from a mouth opening thereof, is guided in a bag gathering means to gather that section. Heat sealing means fuses the gathered section. A second bag support platform is positioned under the trap door simultaneously when the bag with the articles is positioned in the gathering means. Bag discharge means is provided for discharging the sealed bag from the first bag support platform at the sealing station and onto the discharge conveying means.

BRIEF DESCRIPTION OF DRAWINGS

A preferred embodiment of the present invention will now be described with reference to the accompanying drawings, in which:

FIG. 3 is a simplified perspective view showing the operation of the clamping device;

FIG. 4 is a simplified top view of the automatic bagging machine;

DESCRIPTION OF PREFERRED EMBODIMENTS

Figure 1:
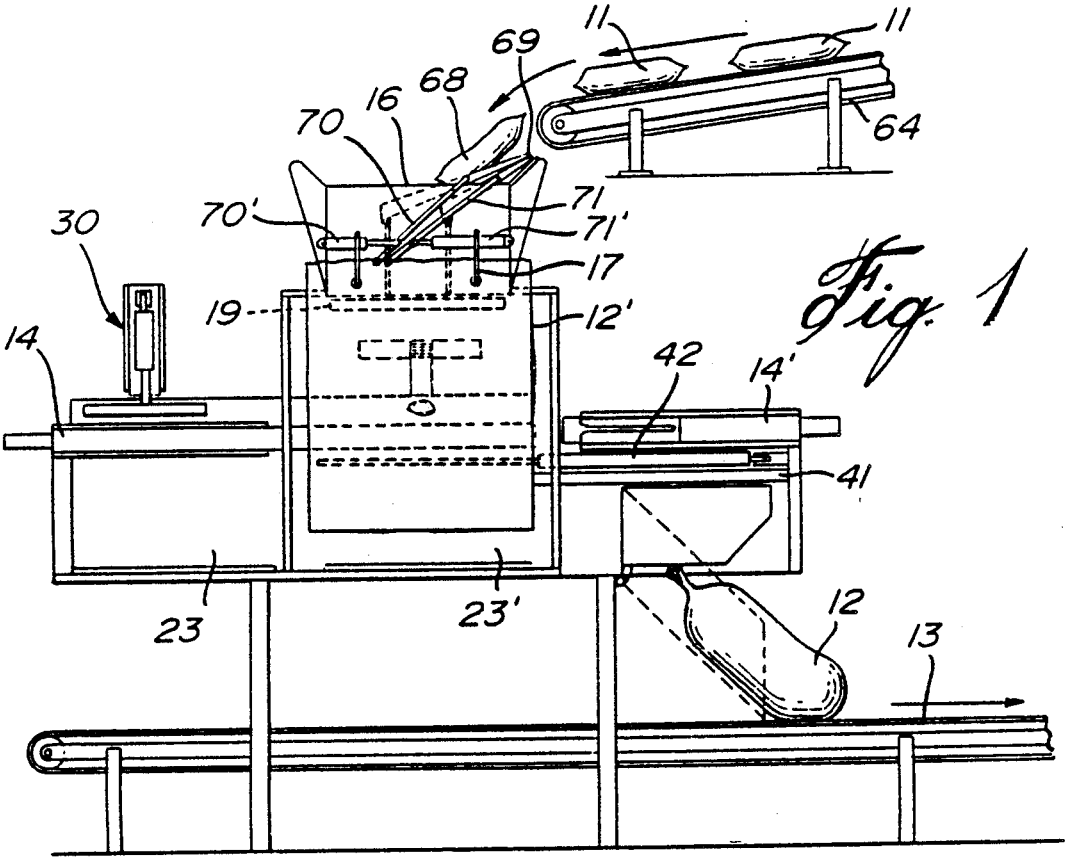
FIG. 1 is a simplified schematic view illustrating the automatic bagging machine of the present invention.

Referring to the drawings, and more particularly to FIGS. 1 to 4, there is shown generally at 10 the automatic bagging mahcine of the present invention for positioning articles 11, herein milk pouches, or any other type article or articles in a plastic bag 12. Prior to releasing the plastic bag 12 on the discharge conveyor 13, the bag is fed to a sealing station 14 where it is gathered to form a gathered neck 15 (see FIG. 6) and sealed.

Figure 2:
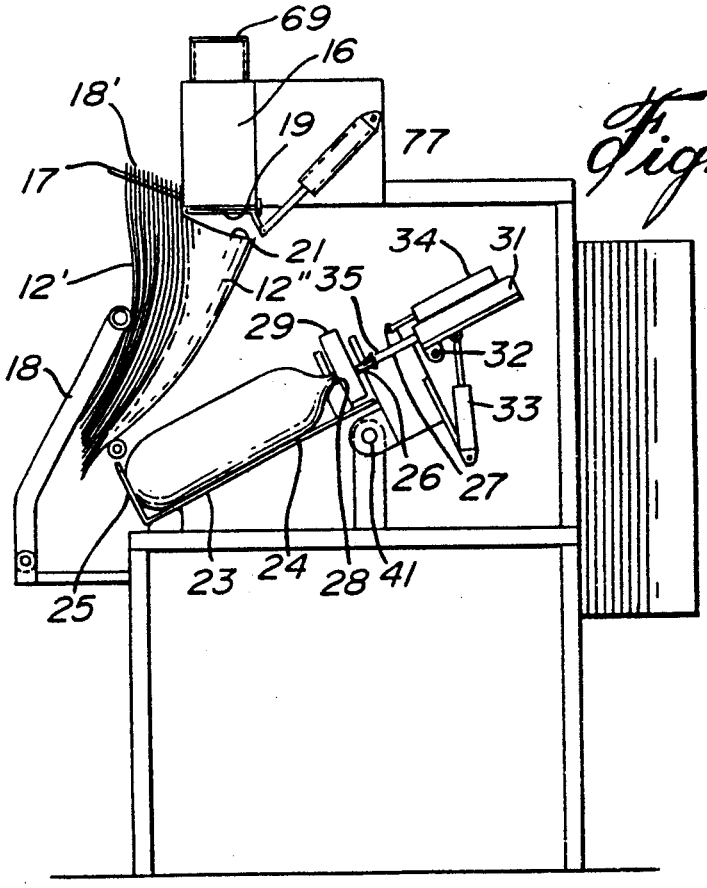
FIG. 2 is a simplified end view showing the relative positions of the collector, the bags prior to loading, and the bag support platform together with the clamping device.
Figure 10:
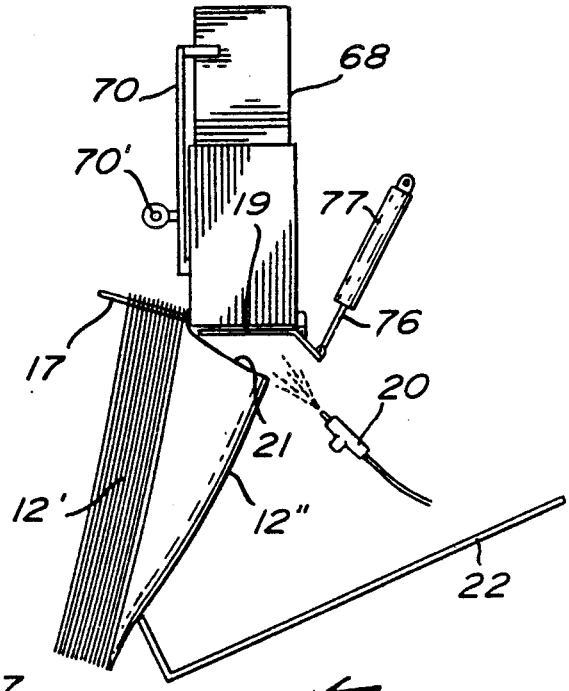
FIG. 10 is an end view showing the position of the bag relative to the trap door under the collector.
Figure 11:
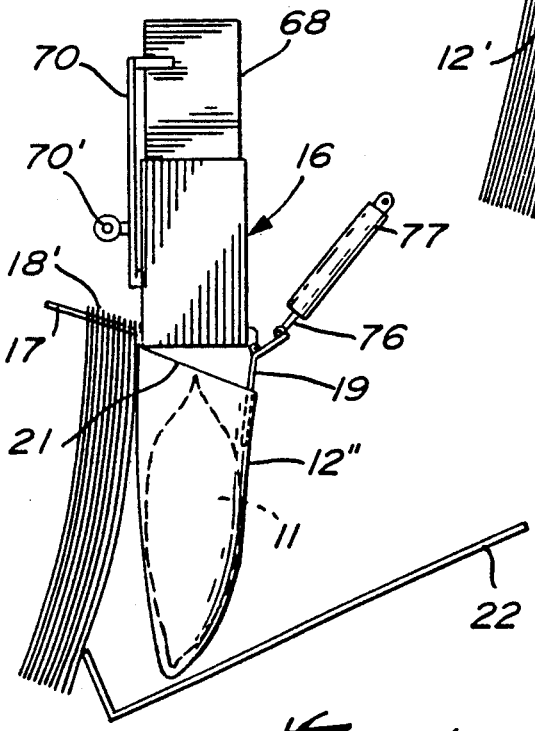
FIG. 11 is a view similar to FIG. 10 but showing the articles as transferred within the open mouth bag.

The machine comprises a collector 16 in which there is positioned a predetermined number of articles 11 to be placed in a single bag 12. As shown in FIG. 2, a plurality of bags 12' are stacked on support wicker pins 17 and advanced towards the collector 16 by means of a pusher element 18 so that a first bag 12" is positioned under the trap door 19 of the collector 16. The open top end of the first bag 12" is firstly opened by an air jet 20 (see FIG. 10) and when the articles 11 are released therein from the collector 16, the trap door 19 engages within the open mouth 21 of the bag 12" to pull it wide open and taut, as shown in FIG. 11, so that the articles 11 may be received therein. As soon as the articles are released in the open bag 12", the weight of the articles will rip the engaged flap 18' of the bag 12" from the wicker pins 17. This bag holding and filling means just described is well known in the art.

Referring now more particularly to FIGS. 2 to 4, there is shown the construction and operation of the displaceable support means 22 which is comprised of two bag support platforms 23 and 23' formed of a base plate or base wall 24 having a transverse end plate 25 secured therein whereby to receive the bag 12" and its contents therein. The base wall 24 extends at an angle so that the filled bag 12' will fall with its top open end portion 26 extending in the direction of a backing plate 27 extending in the same plane as the base wall 24 and spaced therefrom to form a gap 28 therebetween into which the sealer 29 is received when the support platforms 23 and 23' are displaced to their respective sealing stations 14 and 14'.

Clamping means 30 in the form of a clamp plate 31 is hingedly secured to a hinge bracket 32 and operated from a bag receiving position as shown in FIG. 3 to a bag clamping position as shown in FIG. 2 by means of an actuating piston 33 whereby to clamp the top end portion 26 of the bag 12" onto the backing plate 27. However, in order to have the bag open end portion 26 taut across the gap 28, the clamp plate 31 is mounted on a retraction piston 34 so that the friction surface 35 of the plate is initially positioned in the region of the front end 27' of the backing plate 27, as shown at 36, and retracted over the backing plate 27 to its position as shown at 37 in the direction of arrow 38. The friction surface 35 is constructed of rubber material or other suitable friction retention material and provided with a plurality of ridges 35' to assure good frictional retention of the plastic bag over the backing plate 27.

After the clamping means 30 has engaged the top open end portion 26 of the bag, the displaceable support assembly 22 is shifted axially in the direction of arrow 40, as shown in FIG. 4, on guide rods 41 by means of a platform displacing piston 42 mounted under the displaceable support assembly 22. Accordingly the back support platform 23' is advanced to the sealing station 14' and the other back support platform 23 is positioned under the collector 16 to receive the next load of articles 11 from the collector.

Figure 5:
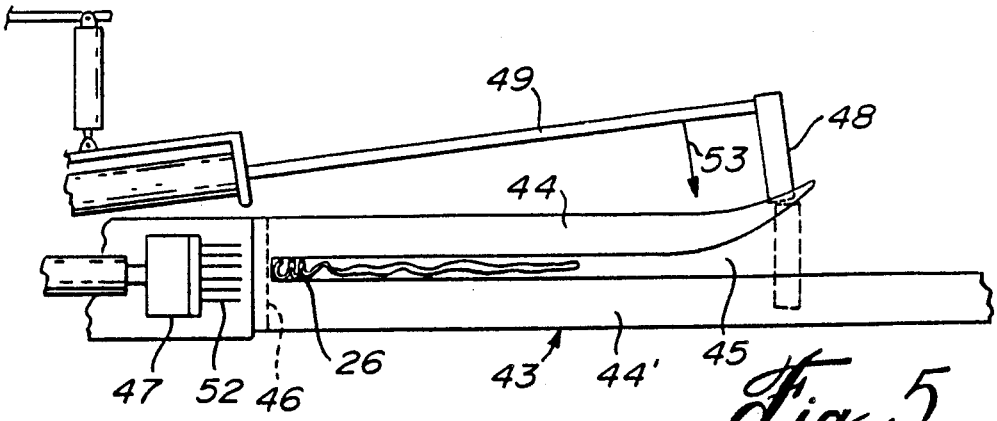
FIG. 5 is a side view illustrating the construction and operation of the gathering means.
Figure 6:
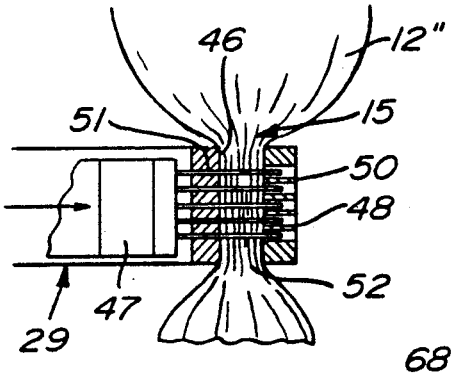
FIG. 6 is a simplified top view illustrating the operation of the pin sealer.

With particular reference now to FIG. 5, it can be seen that as the back support platform 23' advances to the sealing station 14', a portion of the top end portion 26' enters into a bag gathering means which is comprised of a guide member 43 which consists of two jaw plates 44 and 44' which have an open end 45 with the jaw tapering inwardly from the open end and terminating at a stop wall 46 which is constituted by the front face of a pin sealer 47, see FIG. 6. As the top end portion 26' of the bag is entered into the jaw of the guide member 43, the front end portion of the bag will gather itself in the region closest to the stop wall 46. However, the outside portion of the bag is substantially ungathered because the support platform 23 has gone to its maximum travel in alignment with the sealing station 14'. Therefore, in order to gather the remaining portion of the bag, there is provided a bag pulling means which is constituted by a gathering bar 48 mounted on a piston activated lever arm 49. After the top end portion of the bag has been inserted within the jaw, the pivoted actuating lever 49 positions the gathering bar 48 into the open end 45 of the jaw (as indicated by arrow 53) and retracts the bar against the bag portion within the jaw. This causes the bag portion within the jaw to gather to form the neck portion 15, as shown in FIG. 6. As also shown in FIG. 6, the gathering bar 48 is provided with a plurality of holes 50 therein which are aligned with holes 51 also provided in the stop wall 46 of the pin sealer 47. A plurality of heated sealing pins 52 then project out of the holes 51 of the pin sealer, across the gathered neck portion 15 of the plastic bag, and into the aligned holes 50 in the gathering bar 48. The pins are then immediately retracted and the heat of these pins has now formed a seal in the neck portion 15. This pin sealer is known in the prior art and no further description thereof is deemed necessary.

After or during the formation of the heat seal of the neck of the bag, the support platform 23' moves back under the collector 16 to receive another filled bag thereon. The support platform 23 then moves to the other sealing station 14 to again repeat that cycle. As the platform 23 is displaced from the sealing station, the gathering plate 48 still retains the bag at the sealing station and the bottom end of the bag is supported and guided by means of a support plate 55 disposed immediately under the support platform at the sealing station. This support plate is pivotally connected on a pivot connection 56 and guidingly supports the bag onto the discharge conveyor 13 positioned thereunder with the support plate pivoting on the connection 56 in the direction of arrow 57. During this time, the bag top end portion is still held by the gathering plate to give sufficient time to the formed seal in the neck portion 15 to cool down. Accordingly, when the bag is released by the gathering plate, the seal is set and cannot tear apart by pressure applied thereagainst by the articles in the bag, when the bag is released onto the discharge conveyor 13. The support wall 55 also acts as a slide so as to minimize the impact on the bag when discharged on the discharge conveyor 13.

Referring now to FIG. 4, it can be seen that the backing plates 27 are each provided with a hole 59 disposed at a predetermined position thereon and in alignment with the clamp plate 31 when in its bag holding position. This hole provides for the passage therein of a printing head 60 which is located under the backing plate. During the sealing operation, the printing head 60 will move into the hole 59 and imprint a date on the top end portion of the bag with the clamping plate 31 providing a backup surface for the printing head.

It is pointed out that the bagging machine of the present invention was designed to be economical, efficient, fast and substantially entirely automatic. This is achieved by providing a displaceable support means having two support platforms axially displaced to a respective one of two sealing stations 14 and 14' disposed in axial alignment with the axis of displacement of the support means 22 on a respective side of the collector 16. Accordingly, the collector may be continuously loaded by conveyor 64 with articles 11. When a bag is being sealed, another bag is loaded and there is therefore provided only two cycles in the operation, and that being of moving the displaceable support assembly on a straight axis from one side to the opposite side.

Figure 7:
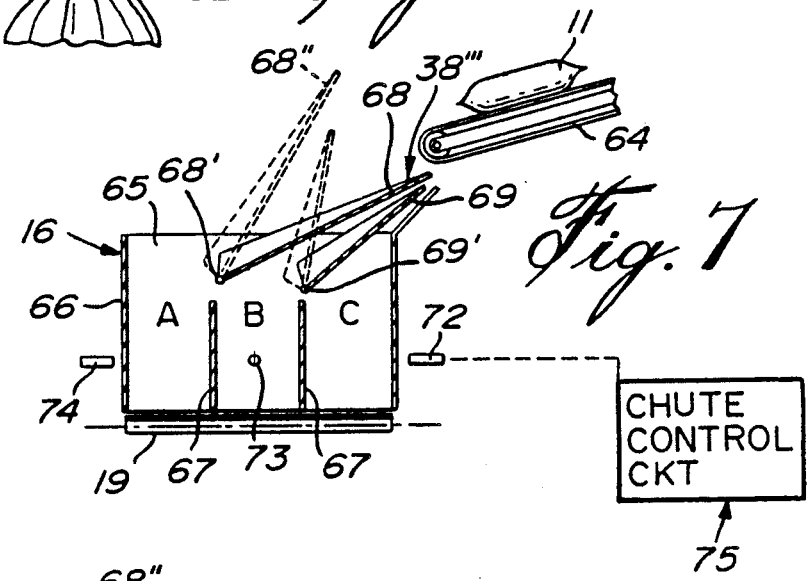
FIG. 7 is a section view showing the construction of the collector.
Figure 8:
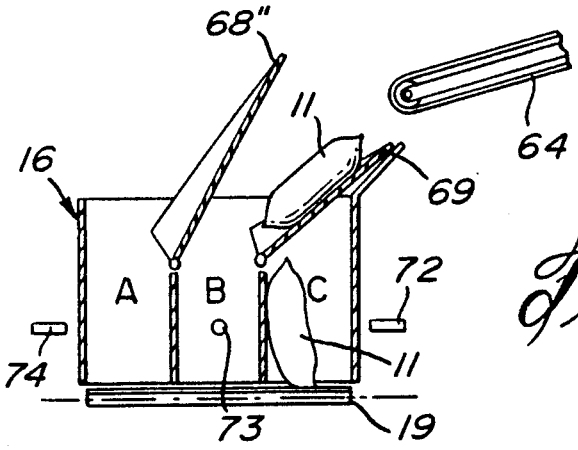
FIG. 8 is a view similar to FIG. 7 but showing the articles being transferred into the compartments of the collector and the operation of the chutes.
Figure 9:
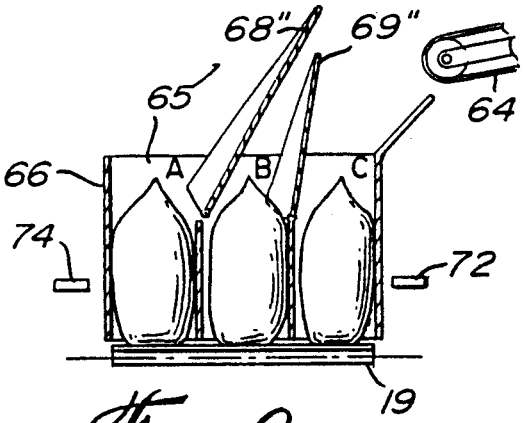
FIG. 9 is a section view similar to FIG. 8 but showing three articles positioned in each of the compartments of the collector.

Referring now additionally to FIGS. 7 to 11, there will be described the construction and operation of the collector housing 16. As herein shown, the collector housing is utilized as a collator to direct the articles, herein milk pouches 11, into three separate compartments, namely compartments A, B and C. The housing is a rectangular housing having side walls 65 and end walls 66. The top end of the housing is an open top with the bottom end being closed by the trap door 19. Division walls 67 separate the housing into the compartments. In addition, displaceable transfer chutes, herein transfer chutes 68 and 69, are hingedly connected on a hinge 68' and 69' respectively, and direct the articles to the compartments. The chutes are actuated by linkage 70 and 71 respectively, from an article receiving position, as shown in FIG. 7, to an article discharge position, as shown in FIG. 9. The linkage 70 and 71 is actuated by pistons 70' and 71' (see FIG. 1). These pistons are commanded by a control circuit 75, as shown in FIG. 7, including sensors 72, 73 and 74, associated with each compartment C, B and A, respectively. The detectors 72 to 74 detect when an article 11 has been placed in a respective compartment. As soon as all compartments are filled, the actuation of the chute circuit 75 causes the trap door 19 to open and release the contents from the collector 16. The pouches are then dropped from the collector into the open mouth bag 12''. As soon as the trap door 19 closes and the detector 72 has detected a first pouch in compartment C, the chute 69 is then actuated by its respective linkage to position it at a bag receiving position, as shown in FIG. 8. The second compartment B then receives a pouch and the detector 73 sends a signal to the control circuit 75 to activate the other chute 68 to place it into a bag receiving position, as shown at 38''' in FIG. 7, where the third compartment A then receives an article 11. The detector 74 is then actuated and the trap door 19 is again opened. It can therefore be noted that the compartments A, B and C are loaded in sequence and in reverse. Accordingly, the housing or collator 16 may receive articles therein more quickly than with similar prior art collectors where the cutes have to be reset by a gravity operated linkage to load the compartments in a single sequence from A to C.

With the prior art bag loaders, it is necessary to displace the gates twice to load each collector compartment. With this present pneumatic control arrangement, the gates are only displaced once per compartment loading, as pointed out above. It is also pointed out that when a pouch is released in compartment B, the signal from the detector light source 73 is fed to the control circuit and this activates the air jet 20 which causes the mouth opening of the first bag 12'' on the wicker pins 17 to open, as shown in FIG. 10. When the trap door 19 is opened by retracting piston rod 76 of piston 77, the trap door enters the mouth opening 21 of the bag 12'' and pull it out taut, as shown in FIG. 11, to make sure that the articles 11 are properly directed therein. The weight of the articles 11 in the bag 12'' causes the flap portion 18' tear off from the wicker pins 17 and the bag falls on the support platform 23 or 23'. As soon as the trap door 19 is open, the air jet 20 is shut off by the control circuit 75.

It is within the ambit of the present invention to cover any obvious modifications of the preferred embodiment described herein, provided such modifications fall within the scope of the appended claims. For example, all types of articles may be directed in the compartments of the collector. Also, the collector may have only two compartments or a single compartment with many articles discharged therein. Still further, although the invention has been described with respect to a pin sealer, the sealer may be a bar sealer and the printing head may have incorporated therein other information and even print a logo on the bag.

I claim:

1. An automatic bagging machine for positioning articles in a bag and sealing said bag prior to releasing same on discharge means to displace it from said machine, said machine comprising a collector for receiving a predetermined number of articles to be placed in a single bag, a trap door under said collector, support means for holding a plurality of stacked collapsed bags having an open top end, means for holding a first of said stacked bags adjacent said trap door, means for opening said first bag to position its opened end under said trap door, control means to release said predetermined number of articles in said opened end of said first bag, displaceable support means having a first bag support platform positioned spaced under said collector for supporting said bag from a bottom end thereof when said articles are disposed within said bag, clamping means to retain a top open end portion of said bag on a clamping surface, means to displace said displaceable support means to position said bag with said articles therein to a sealing station where a section of said top end portion of said bag spaced from a mouth opening thereof is guided in a bag gathering means to gather said section, heat sealing means for fusing said gathered section, a second bag support platform positioned under said trap door simultaneously when said bag with said articles is positioned in said gathering means, and bag discharge means for discharging said sealed bag from said first bag support platform at said sealing station onto said discharge conveying means.

2. An automatic bagging machine as claimed in claim 1 wherein said bag gathering means comprises a guide member having a guide slot into which said section of said top end portion is advanced, a stop wall in said guide slot against which an edge portion of said section is arrested and gathered, and pulling means to pull said section from an opposed edge to gather said section in said slot.

3. An automatic bagging machine as claimed in claim 2 wherein said stop wall has a plurality of holes therein, said pulling means is a gathering bar having holes therein aligned with said holes in said stop wall, said gathering bar being displaceable toward said stop wall, sealing pins protruding from said holes in said stop wall and aligned with said holes in said gathering means, heating means for heating said pins, said pins protruding through a gathered neck portion of said bag and into a portion of said holes to melt plastic material of said bag to form a seal, and means to advance and retract said pins from said holes in said stop wall.

4. An automatic bagging machine as claimed in claim 2 wherein said clamping means is a clamp plate having a frictional engaging face positioned against said top end portion of said bag resting on a flat backing surface, and pulling means to pull and clamp said top end portion on said backing surface.

5. An automatic bagging machine as claimed in claim 4 wherein said backing surface is a flat support backing wall secured in spaced relationship with each of said first and second bag support platforms and defining a gap therebetween, said bag gathering guide member being aligned with said gap of its respective bag support platform.

6. An automatic bagging machine as claimed in claim 5 wherein said clamp plate is secured to a hinge connection to displace said clamp plate from a position of rest extending outwardly of said backing surface to a position of use disposed in the direction of said backing surface.

7. An automatic bagging machine as claimed in claim 6 wherein said clamp plate is displaced on said hinge connection by a first piston, and a second piston for pulling said clamp plate over said top end portion of said bag towards said bag open end to position said bag taut across said gap.

8. An automatic bagging machine as claimed in claim 7 wherein said bag support platform comprises a base plate and an angulated side support wall, said backing wall extending in the same angulated plane as said side support wall.

9. An automatic bagging machine as claimed in claim 8 wherein there is further provided at said sealing station printing means for printing information on a top portion of said bag above said gathered portion.

10. An automatic bagging machine as claimed in claim 9 wherein said printing means comprises a printing head disposed under said backing wall, a hole in said backing wall aligned with said clamp plate positioned over said top end portion of said bag so as to expose a section thereof adjacent said hole, said clamp plate providing a backup surface for said printing head.

11. An automatic bagging machine as claimed in claim 3 wherein said bag discharge means comprises a support plate disposed under said bag support platform at each said sealing stations, said bag being retained between said stop wall and gathering bar when said platform is retracted so as to retain said bag and cause it to rest on said support plate, said heat seal being cooled by the delay in releasing said sealed gathered neck portion after said sealing pins have retracted into said stop wall.

12. An automatic bagging machine as claimed in claim 11 wherein said support plate is a hinge plate which guides said sealed bag over a discharge conveyor positioned thereunder, said sealed bag being released by retracting said gathering bar.

13. An automatic bagging machine as claimed in claim 1 wherein said displaceable support means is an axially displaceable table, said table having two bag support areas located spaced apart in side-by-side relationship, an actuating piston connected to said table for displacing said first and second bag support platforms sequentially from a bag loading position under said collector to a bag sealing position at a respective side of said collector on a straight axis.

14. An automatic bagging machine as claimed in claim 13 wherein said collector is a collating open-ended housing having said trap door positioned thereunder to form a bottom support wall, said housing having two or more compartments for receiving an article in each compartment, displaceable transfer chutes associated with said compartments and a feed means to transfer said articles from said feed means to respective ones of said compartments in sequence, and detection means to detect the presence of an article in each said compartment.

15. An automatic bagging machine as claimed in claim 14 wherein said detection means is connected to a chute control circuit to operate said transfer chute to displace them from an article pick-up position to an article transfer position, said transfer chutes being operated in sequence and from opposed ones of said compartments.

16. An automatic bagging machine as claimed in claim 15 wherein there are three of said compartments and two of said transfer chutes, said control circuit associated with said second compartment also operating an air jet to direct an air stream at the mouth of said first stacked bag to open said mouth.

17. An automatic bagging machine as claimed in claim 16 wherein said control circuit associated with said third compartment also operates a piston connected to said trap door to hinge out said door into said open mouth of said first bag to pull an outer side wall of said first bag taut while said articles in said three compartments are discharged into said first bag to cause said first bag to automatically release from said means for holding and fall by gravity on said first or second bag holding platforms, said air jet being shut off by said control circuit of said third compartment.

18. An automatic bagging machine as claimed in claim 17 wherein said articles are milk pouches.

19. An automatic bagging machine as claimed in claim 12 wherein said sealing means is a heat-sealing means, there further being provided air jet means for cooling said sealed portion of said bag after said heat-seal has been effected.

* * * * *